US010010187B1

(12) United States Patent
Mencio

(10) Patent No.: US 10,010,187 B1
(45) Date of Patent: Jul. 3, 2018

(54) TUBULAR SPRING ASSEMBLY

(71) Applicant: Charles Mencio, San Antonio, TX (US)

(72) Inventor: Charles Mencio, San Antonio, TX (US)

(73) Assignee: Mark Steven Mencio, La Feria, TX (US)

( * ) Notice: Subject to any disclaimer, the term of this patent is extended or adjusted under 35 U.S.C. 154(b) by 0 days.

(21) Appl. No.: 15/636,022

(22) Filed: Jun. 28, 2017

(51) Int. Cl.
*A47C 23/00* (2006.01)
*A47C 23/30* (2006.01)
*A47C 7/35* (2006.01)
*A47C 23/047* (2006.01)

(52) U.S. Cl.
CPC ..... *A47C 23/30* (2013.01); *A47C 7/35* (2013.01); *A47C 23/002* (2013.01); *A47C 23/047* (2013.01)

(58) Field of Classification Search
CPC ..... A47C 23/30; A47C 23/002; A47C 31/123; A47C 7/35
USPC ..... 267/142, 37.2, 262, 117, 120, 131
See application file for complete search history.

(56) References Cited

U.S. PATENT DOCUMENTS 986,183 A * 3/1911 Leahan ..... A47C 23/002 5/258
3,572,621 A * 3/1971 Whitten ..... F16F 15/067 248/548
3,656,190 A * 4/1972 Regan ..... A47C 23/00 5/600
3,999,234 A * 12/1976 Regan ..... A47C 23/002 5/246
4,842,273 A * 6/1989 Schmeiss ..... A63B 21/05 482/126
4,852,195 A * 8/1989 Schulman ..... A61G 7/05776 297/DIG. 8
5,060,326 A * 10/1991 Oswald ..... A47C 23/002 5/236.1
5,197,975 A * 3/1993 Mombrinie ..... A61G 13/12 128/845
5,210,889 A * 5/1993 Wesemann ..... A47C 23/065 5/236.1
5,332,202 A * 7/1994 Wagner ..... A47C 23/002 267/82
6,383,153 B2 * 5/2002 Dabir ..... A61H 7/001 601/134
6,721,981 B1 * 4/2004 Greenhalgh ..... A47C 23/002 5/253
6,742,202 B2 * 6/2004 Jones ..... A47C 19/005 5/263

(Continued)

FOREIGN PATENT DOCUMENTS

FR 3000884 A1 * 7/2014 ..... A47C 23/002

*Primary Examiner* — Thomas W Irvin
(74) *Attorney, Agent, or Firm* — Gunn, Lee & Cave, P.C.

(57) ABSTRACT

A tubular spring assembly and a series of tubular spring assemblies for use in beds, chairs, or other cushioned surfaces, the tubular spring assembly having a tubular base member, a tubular second member that partially nests and is slidable within the tubular base member, a spring connecting the two tubular members, a ball joint affixed to the exterior of the second member and a pad attached to the ball joint wherein a series of tubular spring assemblies can be arranged within the interior of a bed, chair, or other cushioned surface to provide widely dispersed pressure onto the user.

11 Claims, 4 Drawing Sheets

(56) References Cited

U.S. PATENT DOCUMENTS

| | | | | |
|---|---|---|---|---|
| 6,996,865 | B2 * | 2/2006 | Sabin | A47C 23/00 267/91 |
| 7,520,011 | B1 * | 4/2009 | Liberkowski | A47C 23/002 5/719 |
| 7,740,015 | B2 * | 6/2010 | Hyde | A61F 5/05 128/845 |
| 7,789,086 | B2 * | 9/2010 | Hyde | A61F 5/05 128/845 |
| 8,215,311 | B2 * | 7/2012 | Hyde | A61F 5/05 128/845 |
| 8,714,531 | B2 * | 5/2014 | Roma | A47C 23/0438 267/220 |
| 8,863,338 | B2 * | 10/2014 | Dzioba | A61G 7/05776 5/655.3 |
| 9,273,471 | B2 * | 3/2016 | Fischer | E04F 15/02172 |
| 9,314,108 | B2 * | 4/2016 | DeFranks | A47C 27/04 |
| 9,314,109 | B2 * | 4/2016 | Saunders | A47C 27/04 |
| 9,386,861 | B2 * | 7/2016 | Roma | A47C 23/0438 |
| 2001/0038174 | A1 * | 11/2001 | Muller | E05F 5/022 267/221 |
| 2008/0040861 | A1 * | 2/2008 | Ootayopas | A61G 7/0573 5/715 |
| 2015/0351982 | A1 * | 12/2015 | Krenik | A47C 23/06 5/616 |

* cited by examiner

TUBULAR SPRING ASSEMBLY

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to an apparatus for providing a consistent predetermined amount of outward pressure on the user of a chair or bed while simultaneously dispersing the point of pressure between the user and the surface of the bed or chair.

2. Description of the Related Art

Beds and chairs have surfaces, sometimes padded, on which humans sit, lie, or otherwise physically contact. While in use, the human body is in contact with an exterior surface of the bed or chair. Beds and chairs are made from a variety of different materials, and are often designed to provide maximum comfort and/or convenience for the user. One way to increase comfort is to provide a pad or cushion within the chair or bed surface.

For general comfort and health-related reasons, such as preventing bed sores, improving circulation, and reducing back pain, consistent and widely dispersed outward pressure from a bed or chair onto the human body is desirable. The present invention is an apparatus and process for a bed, chair, or other surface to exert a consistent and widely dispersed outward pressure onto the user.

Bed sores, also known as pressure ulcers, are particularly a problem among people bedridden and/or confined to a wheelchair. Bed sores occur when pressure between a human body and the surface of a bed or chair is concentrated onto a particular spot on the human body for a length of time.

Commercial products are available for reducing the risk of bed sores. For example, the "Airone Alternating Pressure Pads" is a commercially available product with a vinyl mattress pad comprising a series of air pockets mechanically designed to alternatively fill and deflate, thereby preventing pressure from focusing on one point of the user's body for too long.

Other non-mechanical methods are used by hospitals and nursing homes to prevent bed sores. These procedures typically involve physically rotating the bedridden person, and are both painful and invasive to the person being moved. Often times, multiple care workers are required to move a patient. The present invention reduces the possibility of bed sores, provides an overall more comfortable sitting and/or lying experience, and makes it easier for caretakers to move bedridden patients.

BRIEF SUMMARY OF THE INVENTION

The present invention comprises a series of tubular spring assemblies in which a hexagonal pad is attached to a ball joint at the outward end of the tubular spring assembly.

Ideally, a series of tubular spring assemblies are arranged in a honeycomb pattern and placed in a mattress or cushion. When the human body exerts pressure on the surface of a bed or chair, the tubular spring assemblies will exert pressure back onto the human body. The tubular spring assemblies are set to apply a predetermined amount of outward pressure onto the human body by adjusting the length and tension of the spring. The ball joint increases the area of contact between a human and the bed or chair, essentially cupping the portion of the body in contact with the chair or bed. This disperses the point of pressure between the human and the bed, and increases the magnitude and surface area of outward pressure exerted by the chair or bed on the user. The tubular spring assemblies result in the bed or chair pushing back against the user. The increased amount and surface area of return pressure on the user also reduces the manpower needed to move bedridden patients.

DETAILED DESCRIPTION OF THE INVENTION

Figure 3:
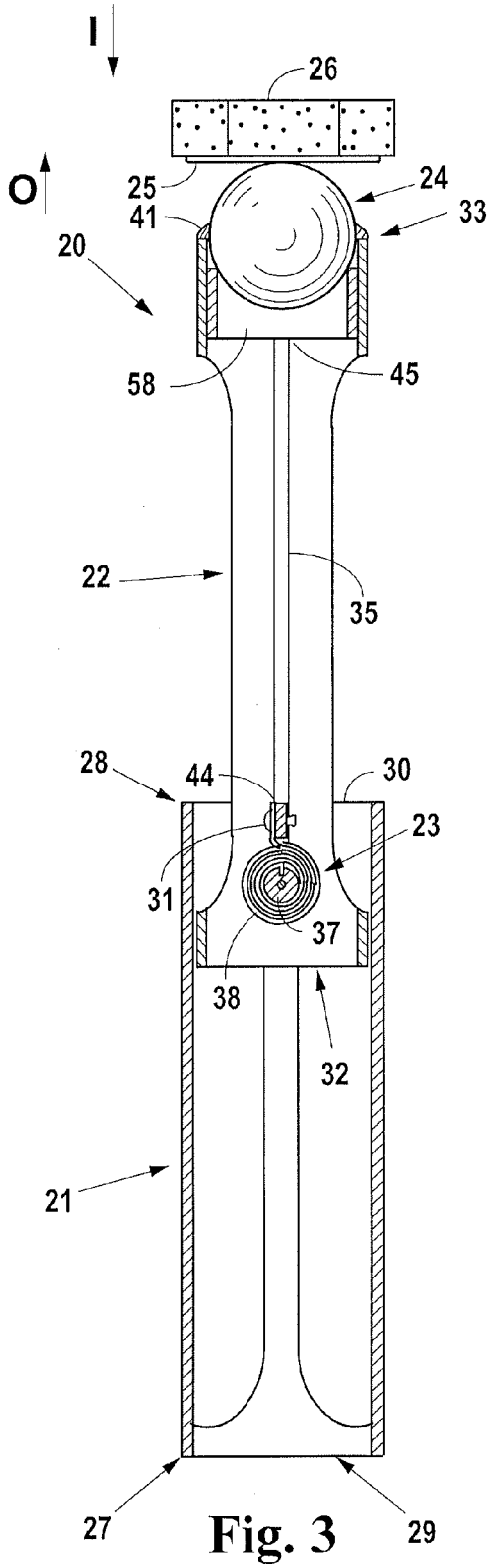
FIG. 3 is a vertical cross section of the first embodiment of the tubular spring assembly in an uncompressed position, wherein the cross section is taken along the central axis of the tubular spring assembly.

The structure of a first embodiment of a tubular spring assembly 20 is described with reference to FIGS. 3-5. The tubular spring assembly 20 comprises a base member 21, a second member 22, a spring mechanism 23, a ball joint 24 affixed the second member 22, a plate 25 affixed to the ball joint 24, and a pad 26 affixed to the plate 25.

The base member 21 is an elongated hollow tube made out of hard plastic. The base member 21 has a first end 27 and a second end 28. The base member 21 has a first opening 29 proximate the first end 27 and a second opening 30 proximate the second end 28. A latitudinal cross member 31 extends across the second opening 30 of the base member 21. The cross member 31 has a first end 52 and a second end 53. The second end 53 of the cross member 31 is coplanar with the second opening 30 of the base member 21. The first end 52 of the cross member 31 is enclosed within the base member 21. The base member 21 has an outer diameter and an inner diameter.

The second member 22 is an elongated hollow tube made out of hard plastic. The second member has a first end 32 and a second end 33. The second member 22 has a max outer diameter and an inner diameter. The max outer diameter of the second member 22 is slightly smaller than the inner diameter of the base member 21. The first end 32 of the second member 22 nests within the second opening 30 of the base member 21. An interior ring 58 is affixed within the second member 22. The interior ring 58 has a max outer diameter slightly smaller than the inner dimeter of the second member 22, and is affixed to the second member 22 with glue or similar adhesive. The interior ring 58 has a first end 60 and a second end 61. The first end 60 of the interior ring 58 is distal the second end 33 of the second member 22, and the second end 61 is proximate the second end 33. The second member has first and second longitudinal opposing slits 35*a*, 35*b* in the exterior of the tube. Each slit 35*a*, 3*b* has a first end 44 proximate the first end 32 of the second member 22 and a second end 45 proximate the second end 33 of the second member 22. The slits 35 are slightly smaller in length than the second member 22. When the second member 22 is connected to the base member 21, the cross member 31 of the base member 21 extends through the slits 35 of the second member 22. First and second opposing cylindrical apertures 49 extend through the second member 22. Apertures 49 are between the first end 44 of the slits 35 and the first end 32 of the second member 22.

The spring mechanism 23 is between the first end 32 of the second member 22 and the cross member 31 of the base member 21. The spring mechanism 23 comprises an axle member 34 that extends latitudinaly across the second member 22 proximate the first end 32. The axle 34 is preferably parallel to cross member 31. Each end of the axle 34 is nested in an opposing cylindrical opening 49. A cylindrical drum 37 is rotatably affixed to the axle 34. Plastic spacers 57 may be used to centrally secure the drum 37 on the axle 34. A flat spiral spring 38 is substantially wound around the drum 37. The flat spiral spring has a first end 39 and a second end 40. The first end 39 is attached to the drum 37. The second end 40 is attached to the cross member 31. The spring 38 has a predetermined resistance R.

Figure 4:
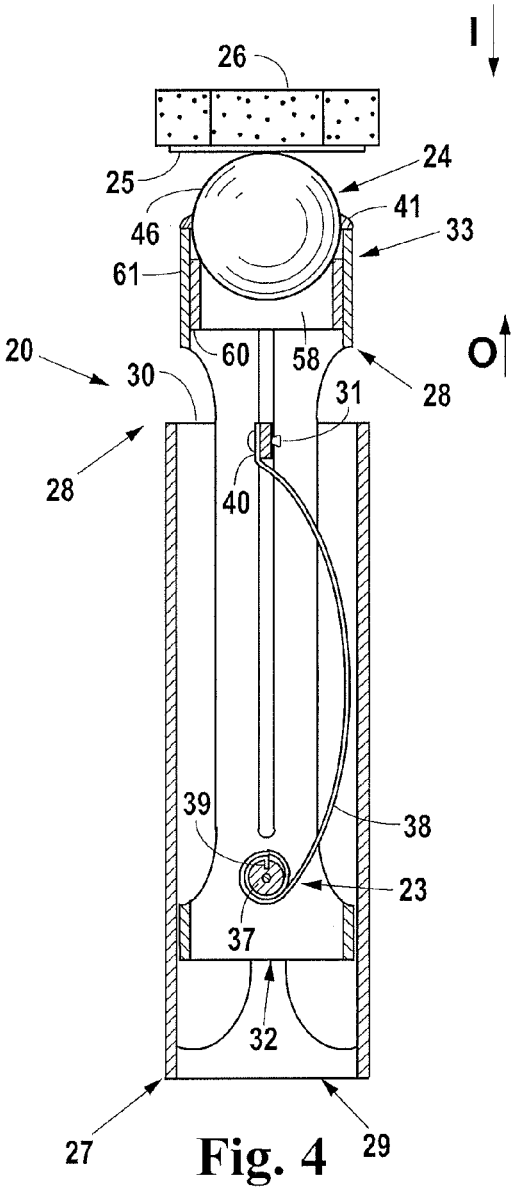
FIG. 4 is a vertical cross section of the first embodiment of the tubular spring assembly in a compressed position, wherein the cross section is taken along the central axis of the tubular spring assembly.
Figure 5:
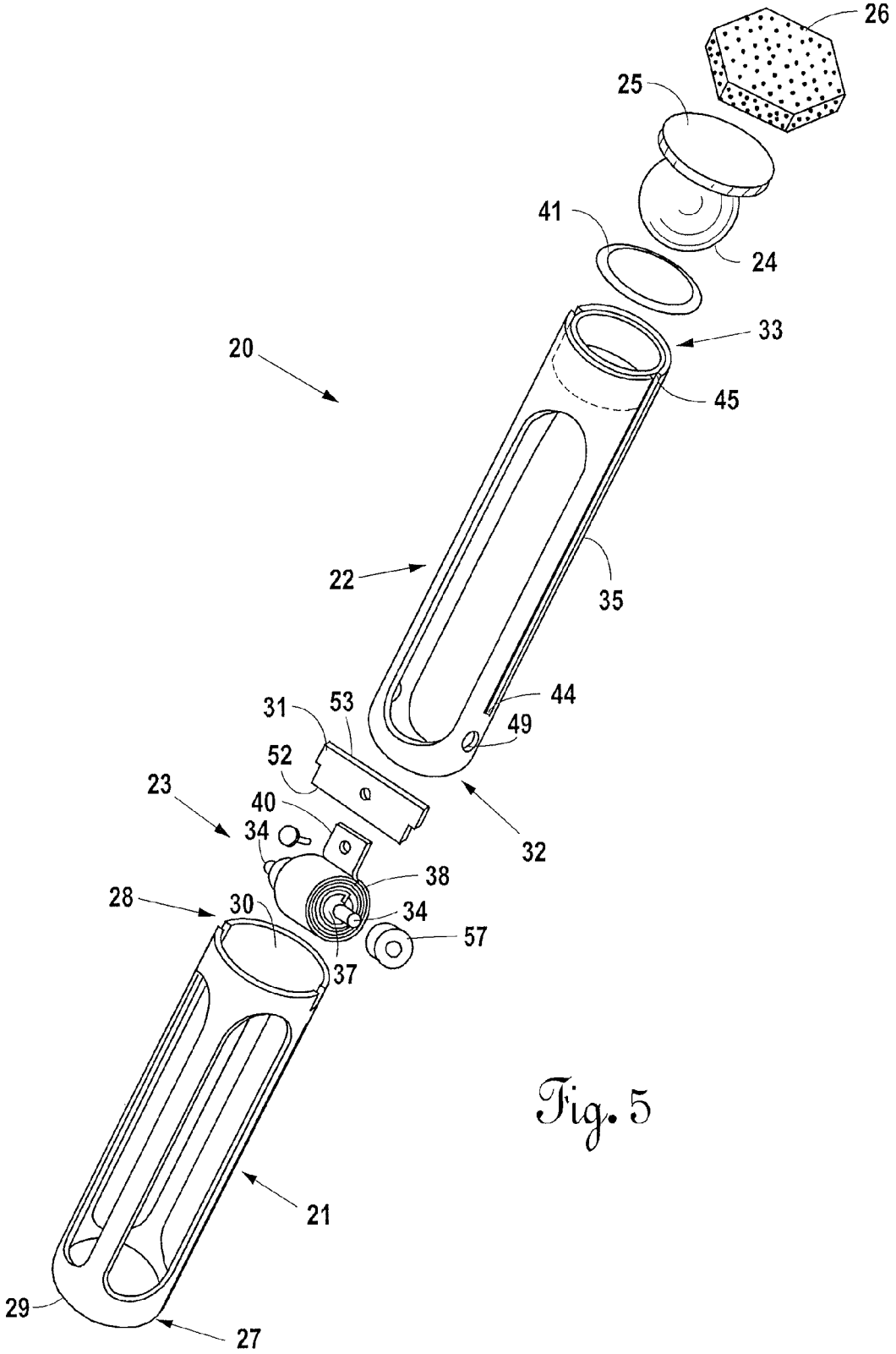
FIG. 5 is an exploded view of the first embodiment of the tubular spring assembly.

Referring to FIG. 4, the ball joint 24 is affixed to, and partially nested within, the second end 33 of the second member 22 and the first end 61 of the interior ring 58. A collar 41 surrounds the edge of the second end 33 of the second member 22 partially enclosing the ball joint 24. The diameter of the ball joint 24 is slightly smaller than the interior diameter of the second member 22. The ball joint 24 has a surface 46 protruding from the second end 33 of the second member 22. A plate 25 is affixed to the surface 46 of the ball joint 24. The hexagonal pad 26 is affixed to the plate 25 opposite the ball joint 24. The ball joint 24 can be glued to the second member 22 for added security.

Figure 1:
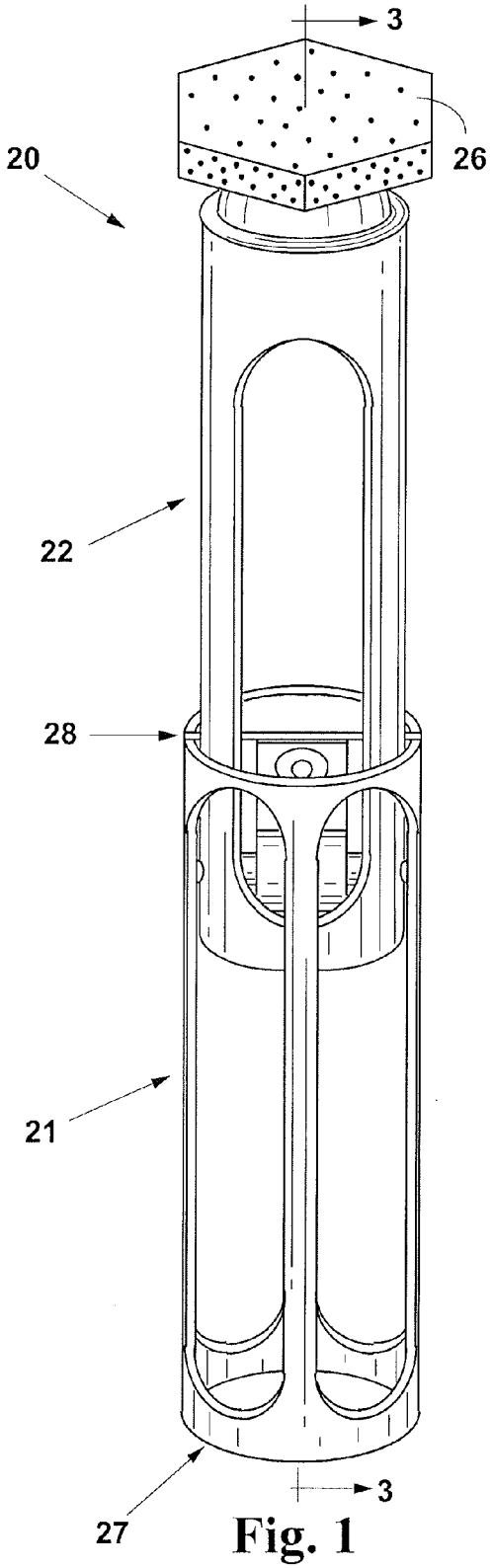
FIG. 1 is a perspective view of a first embodiment of the tubular spring assembly in an uncompressed position.
Figure 2:
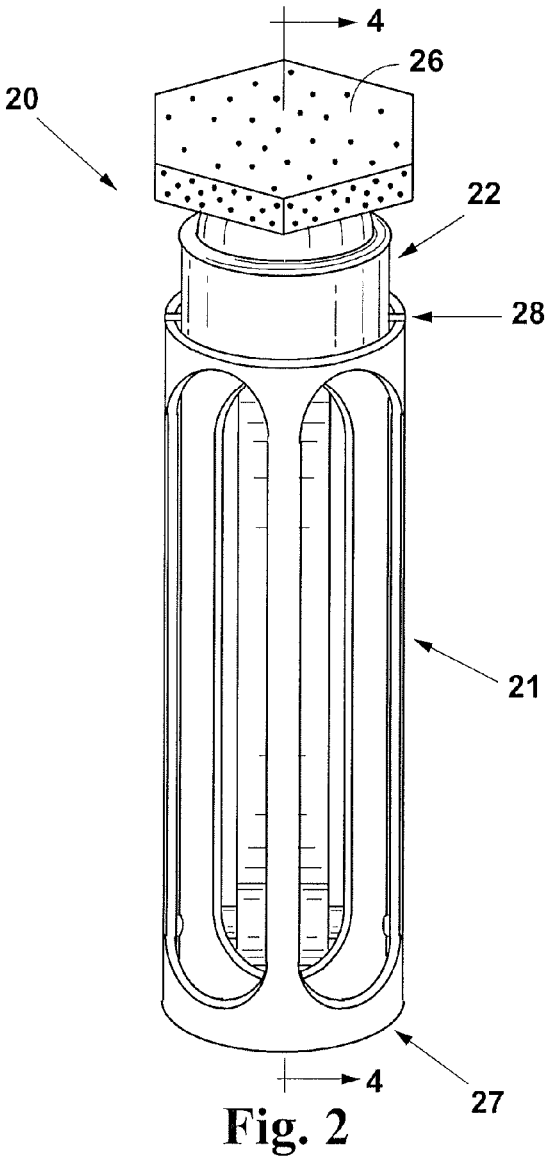
FIG. 2 is a perspective view of the first embodiment of the tubular spring assembly in a compressed position.

The operation of the tubular spring assembly is described with reference to FIGS. 1-2, and 7. In the preferred embodiment, the tubular spring assembly 20 is positioned in the interior of a chair, bed, cushion, or similar surface (not shown), substantially perpendicular to the surface. The first end 27 of the base member 21 is positioned distal the surface and the second end 33 of the second member 22 is positioned proximate the surface. The hexagonal pad 26 is in contact with the surface.

The weight of a user on the surface creates inward pressure I on the hexagonal pad 26. Inward pressure I is pressure in the direction from the hexagonal pad 26 towards the second end 27 of the base member 21. The inward pressure I on the hexagonal pad 26 causes inward pressure I on the second member 22. The inward pressure I on the second member 22 causes pressure on the spring 38. When the inward pressure I created by the user is greater than the resistance R of the spring 38, the drum 37 will begin rotating on the axle 34 and the spring 38 will begin to decoil. The decoiling of the spring 38 allows the second member 22 to slide further into the base member 21. More specifically, the first end 32 of the second member 22 slides within the base member 21 towards the first end 27 of the base member 21. The second member 22 continues sliding into the base member until the resistance R from the spring 38 is greater than or equal to the inward pressure I created by the user, or until the second member 22 is prohibited from sliding any further because the second end 60 of the interior ring 58 of the second member 22 is in contact with the cross member 31 of the base member 21.

The movement of the ball joint 24 within the second member 22 allows the hexagonal pad 26 to tilt approximately forty degrees from the horizontal plane of the tubular spring assembly 20 in every direction. The tilt of the hexagonal pad 26 increases the ability of the tubular spring assembly 20 to absorb inward pressure I from user contact with the surface. Direct inward pressure from a user is not required to activate the tubular spring assembly 20, because the ball joint 24 converts pressure from other angles into inward pressure I. This creates more overall inward pressure I on the tubular spring assembly 20 and increases activation of the tubular spring assemblies 20.

In response to inward pressure I created by a user, the tubular spring assembly 20 exerts corresponding outward pressure O on the surface and user. Outward pressure O is pressure in the direction from the first end 27 of the base member 21 towards hexagonal pad 26. In the preferred embodiment, the tubular spring assembly 20 is set to provide one pound per square inch of O onto the surface and user. However, the tubular spring assemblies 20 are designed to be customizable, and to provide any desired amount of O.

The movement of the ball joint 24 and the tilt of the hexagonal pad 26 can re-direct outward pressure O from the tubular spring assembly 20 approximately forty degrees from the horizontal plane of the tubular spring assembly 20 in all directions. This increases the potential surface area of outward pressure O created by the tubular spring assembly 20, and decreases the amount of outward pressure O focused on any one point of contact between the user and the surface.

Figure 7:
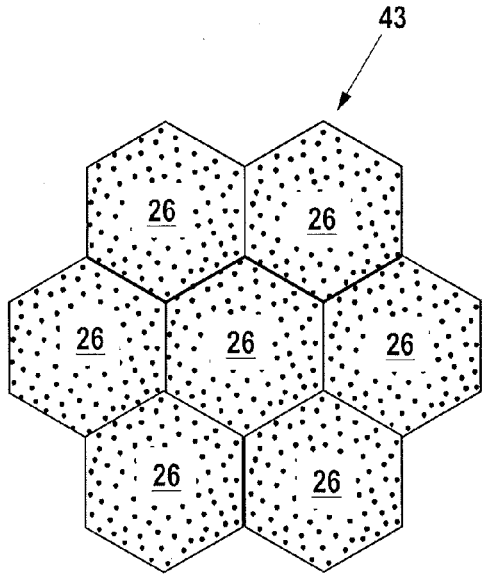
FIG. 7 is a top view of a series of tubular spring assemblies arranged in a honeycomb pattern.

As shown in FIG. 7, the tubular spring assemblies 20 are arranged in a honeycomb pattern 43 within the interior of a bed or chair surface. Portions of the hexagonal pad 26 of a spring assembly 20 are flush against portions of the hexagonal pads 26 of adjacent spring assemblies 20. Any empty space around spring assemblies 20 on the exterior edges of the honeycomb 43 can be filled in using foam or similar material. Inward pressure I caused by a user sitting or lying on the surface activates the tubular spring assemblies 20 receiving inward pressure I from the contact, and also activates the tubular spring assemblies 20 converting pressure from other angles into inward pressure I. The activated tubular spring assemblies 20 will exert corresponding outward pressure O back onto the surface and user. The ball joints 24 and tilt of the hexagonal pad 26 allow the tubular spring assemblies 20 to exert direct outward pressure O as well as outward pressure O re-directed approximately forty degrees from the horizontal plane of the assembly 20 onto the surface and user. This allows the honeycomb 43 of tubular assemblies 20 to cup the body of the user.

Figure 6:
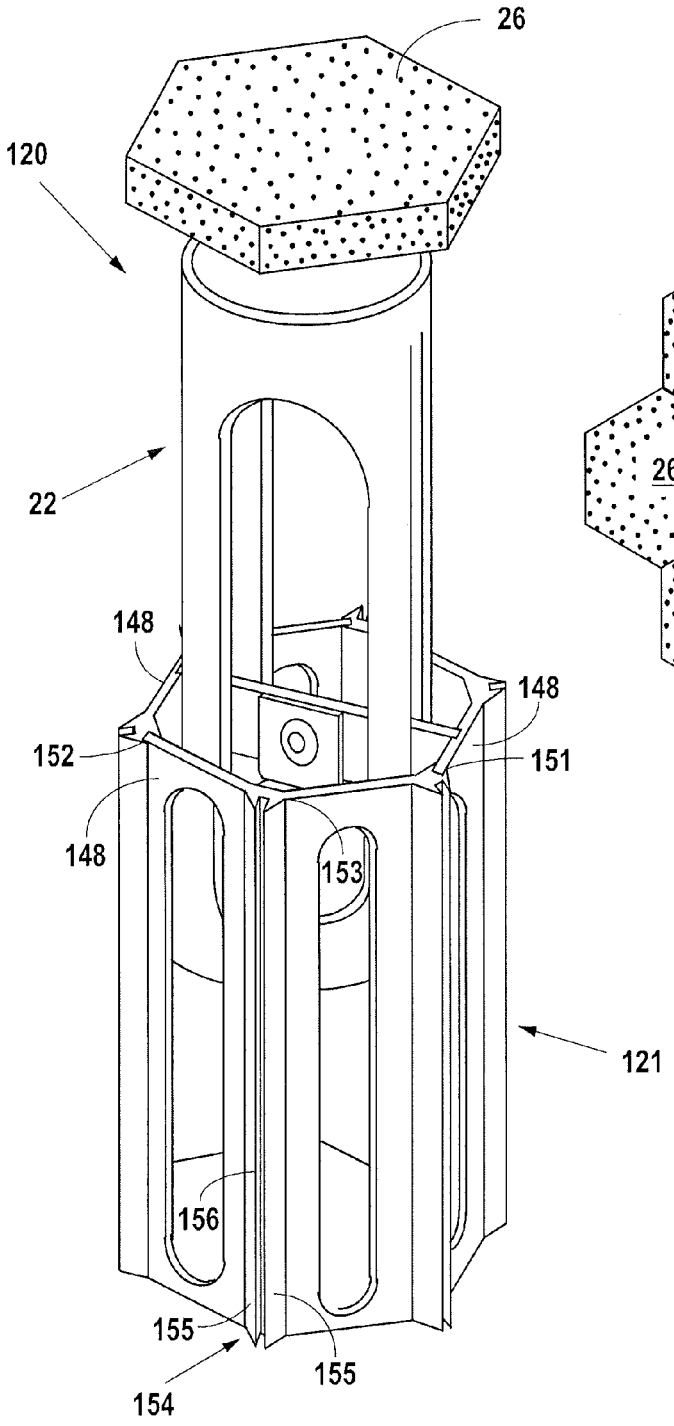
FIG. 6 is a perspective view of a second embodiment of the tubular spring assembly.

Referring to FIG. 6, in a second embodiment 120 of the present invention, the base member 121 is a hexagonal tube. The base member 121 comprises three removable panels 148. Each panel 148 has a first side 152 and a second side 151. The first side 152 is a rectangular prism shape. The second side 151 is a rectangular prism shaped receiving volume. The receiving volume 151 is slightly larger than the rectangular prism 152, allowing the first side 152 of a removable panel 148 to be slidably connectable to the second side 151 of another panel 148. The connection between a first side 152 and second side 151 of two panels 148 for a corner of the hexagonal tube 121. The panels 148 have a midpoint 153 between the first side 152 and second side 151. The midpoint 153 forms a corner of the hexagonal tube 121. The removable panels 148 allow the hexagonal tube 121 to be easily taken apart in order to expose the spring mechanism 23 for maintenance, recalibration, or customization.

Longitudinal connector slots 154 run the length of the panel 148 at the corners of the hexagonal tube 121. The connector slots have two sides 155 and a receiving volume 156. The receiving volume 156 is capable of receiving a side 155 of another connector slot 154, thereby slidably connecting two hexagonal tubes 121. The connector slots 154 allow the user to quickly and easily customize a series of tubular spring assembly 120 into a honeycomb 43 or other pattern. The tubular spring assemblies 121 can also be arranged to provide varying pressure at different points on the human spine. A pattern of spring assemblies 121 of varying heights and providing varying amounts of O can be used to customize a bed or chair for patients with back conditions.

The base member and second member have been described with reference to hard plastic cylindrical tubes. One skilled in the art realizes the tubes could be shaped differently, such as square, elliptical, or hexagonal, and/or made out of other suitable materials.

In other embodiments, the tubular spring assemblies can be attached permanently to one other, attached directly to a chair or bed, contained in a prefabricated pods designed to hold the tubular spring assemblies, or used individually.

The invention claimed is:

1. A tubular spring assembly comprising:

a tubular base member, having a first end, a second end, a first opening proximate the first end, a second opening proximate said second end, and a cross member adjacent to the second end and partially within the second opening;

a second tubular member having a first end and a second end, wherein the first end of the second member is partially enclosed and slidable within the base member;

a spring mechanism having an axle, a drum attached to the axle, and a spring having a first end and a second end, wherein the first end of the spring is attached to the cross member of the base member, and the second end of the spring is attached to said drum;

a ball joint attached to the second end of said second member.

2. The tubular spring assembly of claim 1, wherein in a pad is attached to the ball joint opposite the second member.

3. The tubular spring assembly of claim 1, wherein said spring provides 1 pound per square inch of pressure.

4. A series of tubular spring assemblies of claim 1 arranged in a honeycomb pattern.

5. The tubular spring assembly of claim 1, wherein said tubular base member is hexagonal in shape.

6. The tubular spring assembly of claim 5, wherein said hexagonal base member comprises:

at least two removable panels, each panel having a first end and a second end, wherein the first end is a rectangular prism and the second end is a rectangular prism shaped receiving volume.

7. The tubular spring assembly of claim 5, wherein each corner of the hexagonal base member comprises a connector slot having two sides and a receiving volume.

8. The tubular spring assembly of claim 1, wherein the spring is enclosed within the tubular base member.

9. The tubular spring assembly of claim 1, wherein the spring is a flat spiral spring.

10. The tubular spring assembly of claim 1, wherein the drum is rotatably attached to said axle.

11. A cushion comprising a series of tubular spring assemblies having;

a tubular base member having a first end and a second end, a first opening proximate the first end, a second opening proximate said second end, and a cross member adjacent to the second end and partially within the second opening;

a second tubular member having a first end and a second end, wherein the first end of the second member is partially enclosed and slidable within the base member;

a spring mechanism having an axle, a drum attached to the axle, and a spring having a first end and a second end, wherein the first end of the spring is attached to the cross member of the base member, and the second end of the spring is attached to said drum;

a ball joint attached to the second end of said second member; and a pad attached to the ball joint.

* * * * *